US005331919A

United States Patent [19]

Root et al.

[11] Patent Number: 5,331,919

[45] Date of Patent: Jul. 26, 1994

[54] MEDICATION SCHEDULING DEVICE

[76] Inventors: John Root, R.R. #1 Box 214, Anamosa, Iowa 52205; Deana N. Root, 756 Hillard St., Springfield, Ohio 45506

[21] Appl. No.: 923,518

[22] Filed: Aug. 3, 1992

[51] Int. Cl.[5] ..... G09F 9/00

[52] U.S. Cl. ..... 116/323

[58] Field of Search ..... 116/225, 306, 307, 308, 116/321, 323; 434/203, 204

[56] References Cited

U.S. PATENT DOCUMENTS

| | | | |
|---|---|---|---|
| 232,482 | 9/1880 | Fitch | 434/203 |
| 532,282 | 1/1895 | Myers | 434/203 |
| 623,376 | 4/1899 | Landenberger | 116/225 X |
| 2,872,742 | 2/1959 | Schott | 434/203 |
| 4,038,937 | 8/1977 | Möe | 116/308 |
| 4,389,963 | 6/1983 | Pearson | 116/308 |

FOREIGN PATENT DOCUMENTS

| | | | |
|---|---|---|---|
| 0103081 | 11/1925 | Austria | 434/204 |
| 1622147 | 10/1970 | Fed. Rep. of Germany | 116/323 |
| 0305225 | 2/1930 | United Kingdom | 434/204 |

*Primary Examiner*—William A. Cuchlinski, Jr.
*Assistant Examiner*—John L. Beres
*Attorney, Agent, or Firm*—Norman B. Rainer

[57] ABSTRACT

A device that reminds the user of the proper administration intervals for medications and confirms such administrations is made of a rectangular framework having a number of horizontally disposed rails, each slidably supporting markers that represent a dose of a particular medication. Information panels are associated with the rails to designate the medications being administered. Trays that store containers of medication are disposed rearwardly of the framework. Adhesive labels are applied to the containers to cause correlation with markers on a particular rail.

1 Claim, 2 Drawing Sheets

MEDICATION SCHEDULING DEVICE

BACKGROUND OF THE INVENTION

1. Field of the Invention

This invention relates to unit dosage medication and more particularly concerns an apparatus for scheduling the ingestion of unit doses of multiple medications, reminding the user when to take unit doses, and recording the ingestion throughout a daily period.

2. Description of the Prior Art

Numerous medication reminder devices have been disclosed in the prior art. Various methods have been employed in attempts to maintain a regular ingestion of prescription and over-the-counter medicines. Related devices are known for preventing accidental overdoses from occurring due to infirm individuals, often elderly, forgetting that medication has already been taken for the prescribed time interval.

Perhaps the most common dosage control method involves the blister packaging of a plurality of unit doses of pills or capsules upon a single card. The card is usually fabricated from plastic or a combination of plastic and paperboard having a multiplicity of dosage-containing depressions. The card typically has a foil backing through which pills may be pressed. Dosage indicia may be imprinted upon the card, or the card may be adapted for interactive usage with a dispenser having indicia intended to remind the consumer when each pill is to be taken. At a glance, the user may determine if the dosage for a given period has been taken. Such unit dosage carding is not available for all medications and often pills sold in such packaging cost significantly more than bulk packaging. Furthermore, elderly individuals often cannot read the small indicia on the package, or press the pills through the foil. Such card packaging is not amenable to liquid or injected medications, and little flexibility is available to accommodate changes in the frequency of dosage made by physicians.

Other types of dosage-reminding devices have been disclosed which may be comprises of rotating circular disks or sliding bars. These devices generally rely upon small indicia and lack flexibility of dosage alteration. Moreover they are not capable of scheduling multiple dosages of multiple medications, as are often prescribed to infirm individuals. Electronic and spring wound timers have been employed but these devices suffer similar limitations.

Some dosage regulating devices are comprised of a multiplicity of pill compartments, each adapted to hold a plurality of pills to be taken at a particular time. Such devices require that the tablets be periodically distributed from a bulk storage container into various compartments. This process is more than a mere inconvenience. During this process, the consumer may inadvertently mix up medications which may look similar, especially to those with poor vision. The result could be harmful or even fatal.

It is therefore an object of the present invention to provide a medication dosage scheduling apparatus which will safely remind an individual when to take a dose of medication, and when a dose has already been taken.

It is another object of the present invention to provide an apparatus of the aforesaid nature which is amenable to use with a plurality of prescribed medications.

It is a further object of this invention to provide an apparatus of the aforesaid nature which can accommodate a variety of dosage schedules and quantities.

It is yet another object of the present invention to provide an apparatus of the aforesaid nature which is easy to use, durable, and amenable to low cost manufacture.

These and other beneficial objects and advantages will be apparent from the following description.

SUMMARY OF THE INVENTION

The above and other beneficial objects and advantages are accomplished in accordance with the present invention by a medication dosage scheduling device comprised of:

a) a substantially rectangular frame having upper and lower horizontal members spaced apart by paired parallel upright members, b) a plurality of horizontally disposed rails removably associated with said upright members, c) an information panel associated with each rail and corresponding to a prescribed time for administration of a medication dosage, and d) a plurality of dosage markers slidably disposed upon each rail, each marker corresponding to a unit of medication dosage, In a preferred embodiment, the markers are color coded. Corresponding color-coded labels may be affixed to medication containers, thereby designating which medication and quantity is to be consumed at each time indicated. In alternative embodiments, a variety of shapes of markers may be used in order to accommodate visually impaired individuals. As the dose of medication is consumed, the corresponding marker is slid from one extremity to the other, thereby indicating that the corresponding dosage has been taken.

In some embodiments, the frame may be supported in a substantially vertical or inclined plane by paired legs associated with said frame. The frame and legs may be associated with paired elongated trays adapted to contain packages of medication. The information panels may be adapted to hold interchangeable labels containing indicia to facilitate changes in medication intervals. The rails are removably associated with the frame to permit changes in quantity of units per dose.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
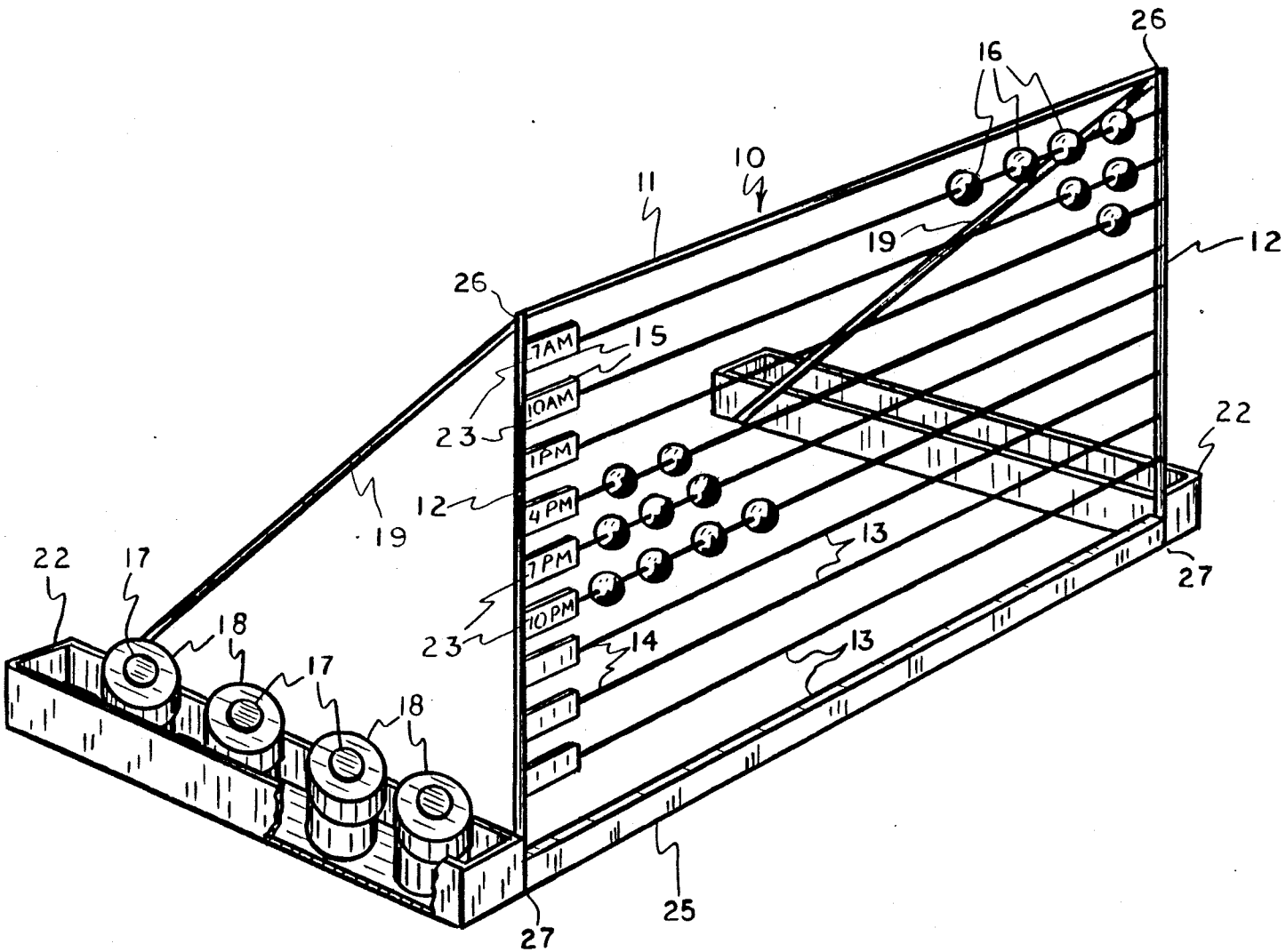
FIG. 1 is a perspective view of an embodiment of the medication scheduling device of the present invention.
Figure 3:
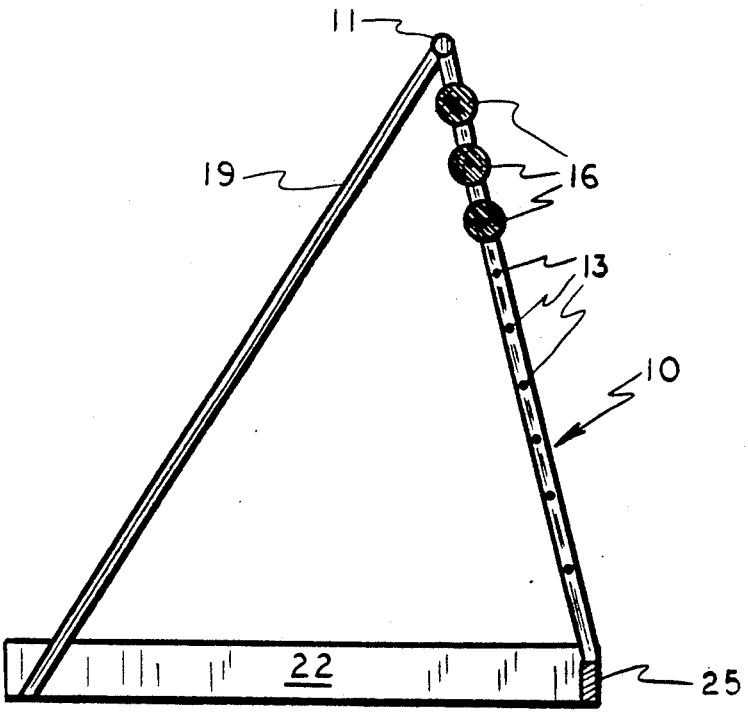
FIG. 3 is a side view of the embodiment of FIG. 1.
Figure 2:
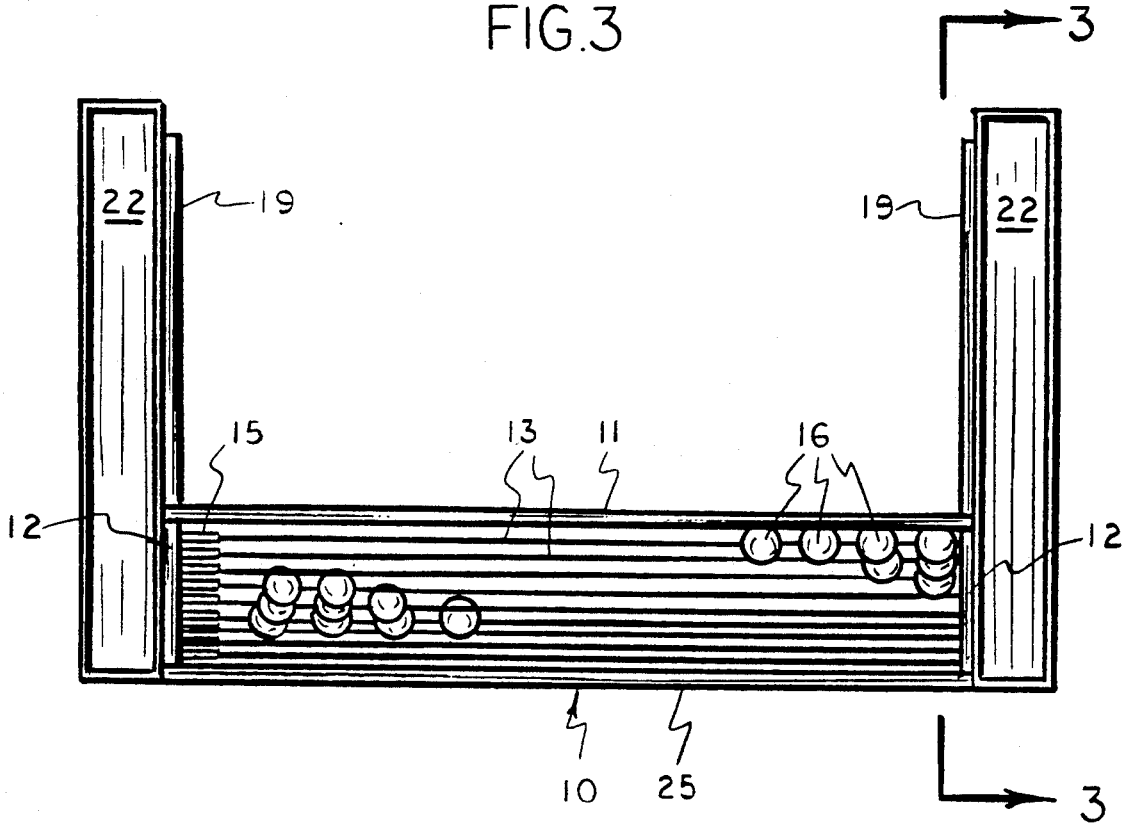
FIG. 2 is a top view of the embodiment of FIG. 1.

Referring to FIGS. 1–3, an embodiment of the medication scheduling device of the present invention is shown comprised of rectangular frame 10 having upper and lower straight rigid horizontal members 11, and 25, respectively spaced apart by paired parallel upright members 12 to form a rectangular array having paired upper corners 26 and paired lower corners 27. Horizontally disposed rails 13, each elongated between extremities 14 are removably associated with upright members 12. Information panels 15 are associated with each of said rails 13, and correspond to a prescribed time for administration of a medication dosage. Dosage markers in the form of beads 16, each having a passageway channel such as a circular bore, are adapted to be slidably reciprocated upon rails 13. Each bead 16 corresponds to a unit of medication dosage.

In the illustrated embodiment, the beads 16 are color coded. Similarly color-coded labels 17 are affixed to medication containers 18, thereby designating which medication and quantity is to be consumed at each time indicated. As the dose of medication is consumed, the corresponding bead 16 is slid from one extremity of rail 13 to the other, thereby indicating that the corresponding dosage has been taken.

In the illustrated embodiment, an elongated tray 22 adapted to contain containers of medication 18, is associated with each upright member. Said trays extend in parallel relationship rearwardly from the lower corners of frame 10. Support legs 19 extend diagonally between upper horizontal member 11 and the corresponding tray 22. The indicia panels 15 have affixed adhesive indicia labels 23, which may be replaced when changes are made in medication intervals. The rails 13 are removably associated with frame 10 to permit changes in the quantity or nature of beads 16 engaged thereupon. The number and color of beads 16 may be changed to reflect modifications in the quantities and types of medication to be taken.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A medication dosage scheduling device comprised of:

a) a substantially rectangular frame comprised of upper and lower straight rigid horizontal members spaced apart by paired parallel straight rigid upright members defining paired upper and lower corners, said upper member being disposed rearwardly with respect to said lower member, b) a plurality of horizontally disposed rails removably associated with said upright members, c) an information panel associated with each rail adjacent an upright member and corresponding to a prescribed time for administration of a medication dosage, d) a plurality of color coded dosage markers slidably disposed upon each rail, each marker corresponding to a unit of medication dosage, and e) adhesive labels color-coded to correspond with the color code of said markers, and adapted to be affixed to medication containers, f) paired elongated trays extending in parallel relationship horizontally rearward from said paired lower corners, and trays configured to hold containers of medication, and g) a support leg extending diagonally between each tray and said upper horizontal member.

* * * * *